United States Patent [19]

Haynes

[11] 4,126,118

[45] Nov. 21, 1978

[54] MODULAR FIREPLACE ASSEMBLY

[76] Inventor: Freddie J. Haynes, 209 SW. 6th, Oklahoma City, Okla. 73125

[21] Appl. No.: 781,719

[22] Filed: Mar. 28, 1977

[51] Int. Cl.[2] ..... F24B 7/04

[52] U.S. Cl. ..... 126/121; 122/20 B; 126/132; 165/58; 165/139

[58] Field of Search ..... 126/121, 133, 143, 132, 126/101; 237/51; 165/58, 137; 122/20 B, 367 C

[56] References Cited

U.S. PATENT DOCUMENTS

| | | | |
|---|---|---|---|
| 1,458,876 | 6/1923 | Confer | 122/20 B |
| 1,938,441 | 12/1933 | Ruesch | 122/20 B X |
| 2,307,600 | 1/1943 | Munters et al. | 126/132 X |
| 3,012,762 | 12/1961 | Norris | 165/137 X |
| 3,174,541 | 3/1965 | Brandt et al. | 165/137 X |
| 3,802,216 | 4/1974 | Brandimarte | 165/58 X |
| 3,954,427 | 5/1976 | Jenn | 126/299 D X |
| 3,977,467 | 8/1976 | Northrup, Jr. | 165/137 X |
| 3,989,030 | 11/1976 | Friedl | 126/110 R |
| 3,999,535 | 12/1976 | Hall | 126/121 |
| 3,999,709 | 12/1976 | Estabrook | 165/DIG. 2 |

FOREIGN PATENT DOCUMENTS

| | | | |
|---|---|---|---|
| 104,826 | 11/1926 | Austria | 122/367 C |

*Primary Examiner*—William E. Wayner
*Assistant Examiner*—William E. Tapolcai, Jr.
*Attorney, Agent, or Firm*—William R. Laney

[57] ABSTRACT

A modular fireplace assembly which comprises a hearth, a firebox around and over the hearth, and an air plenum chamber on opposite sides and to the rear of said firebox in heat transfer relation thereto. A plurality of environmental comfort conditioning subassemblies are removably positioned in a portion of the air plenum chamber to the rear of the firebox, and include a fan subassembly, an air conditioning coil subassembly, and a heater subassembly. A stack extends upwardly from the upper side of the firebox in heat exchange relation to a hot water tank positioned over the firebox. Air conveyance ducting is connected to the upper side of the air plenum chamber, and air return ducts are connected to the lower side of the air plenum chamber.

10 Claims, 7 Drawing Figures

FIG. 2

MODULAR FIREPLACE ASSEMBLY

BACKGROUND OF THE INVENTION

1. Field of the Invention

This invention relates to systems for heating and cooling homes, and more particularly, to a modular fireplace assembly in which the customary heating and cooling units used in a home are incorporated and integrated in a fireplace so that maximum utilization of the heat developed from burning wood in a fireplace is achieved for heating the home.

2. Brief Description of the Prior Art

A number of arrangements and structures have previously been proposed for recovering a portion of the heat developed from the burning of wood in an open hearth fireplace, and using such heat to provide auxiliary heating for the home, thereby minimizing waste by reducing the thermal energy which is lost by venting the fireplace through a stack or chimney to the atmosphere. In some types of systems which have previously been proposed and used, air adjacent the firebox and located over the level at which the wood is burned is simply heated and then vented directly into the room where the fireplace is located so that the radiant heat from the fireplace is supplemented by convection, and as a result of the heat exchange with air located adjacent the upper portions of the firebox. More recently, it has been proposed to place an air plenum structure adjacent the firebox of the fireplace to heat a large volume of air which is then circulated upwardly into a duct system used to transfer the heated air to other rooms of the house remote from that which contains the fireplace.

BRIEF DESCRIPTION OF THE PRESENT INVENTION

The present invention provides a modular fireplace assembly which offers a number of advantages over systems and assemblies which have previously been proposed for recovering a portion of the heat from the stack gases developed by the burning of wood in a wood-burning fireplace. Broadly described, the modular fireplace assembly of the present invention comprises an integrated, generally conventional fireplace, an air plenum chamber positioned adjacent, and in heat exchange relation to, the fireplace, environmental comfort conditioning subassemblies of the sort which are, in general, located in remote areas of the house in other spaces provided therefor, and a water heating system which facilitates the use of the heated stack gases from the fireplace for providing hot water for use in the home. The modular fireplace assembly, as thus constituted in an integral unit, enables a saving of space over that required for both a conventional fireplace and the conventionally located air conditioner and furnace system of the house, and enables maximum recovery of the thermal energy passing upwardly from the fire in the fireplace through the chimney or stack to the atmosphere.

More specifically, the modular fireplace assembly of this invention comprises an open hearth which is defined by a firebox which extends around and over the hearth, an air plenum chamber on opposite sides of and to the rear of the firebox in heat exchange relation thereto and a plurality of environmental comfort conditioning subassemblies which are removably positioned in a portion of the air plenum chamber which is to the rear of the firebox. These comfort conditioning subassemblies include a fan or blower subassembly, an air conditioning coil subassembly, and a furnace or heater subassembly. The stack projects upwardly from the upper side of the firebox in heat exchange relation to a water-containing element which is positioned generally over the firebox. The water-containing element may be a convoluted water-conveying coil or a hot water tank positioned adjacent the stack or flue. Air conveyance ducting is connected to the upper side of the air plenum chamber for receiving heated or cooled air therefrom, and air return ducts are connected to the lower side of the air plenum chamber.

An important object of the present invention is to provide a modular fireplace assembly which is highly efficient in its recovery of heat from the hot gases generated upon the burning of wood in a conventional residential fireplace.

A further object of the present invention is to provide a modular fireplace assembly which provides for compact installation and convenience of location of the air conditioning and heating or furnace units employed in the heating and cooling of air circulated in a conventional residence.

A further object of the present invention is to provide a modular fireplace assembly which can be easily built and installed in the regular and conventional construction of homes.

A further object of the invention is to provide a modular fireplace assembly which can be utilized to supply heated air to the several rooms of a home or residence, and which can also be employed for providing either auxiliary or total heating of water used in the home for cooking and bathing purposes.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF PREFERRED EMBODIMENTS OF THE INVENTION

Figure 1:
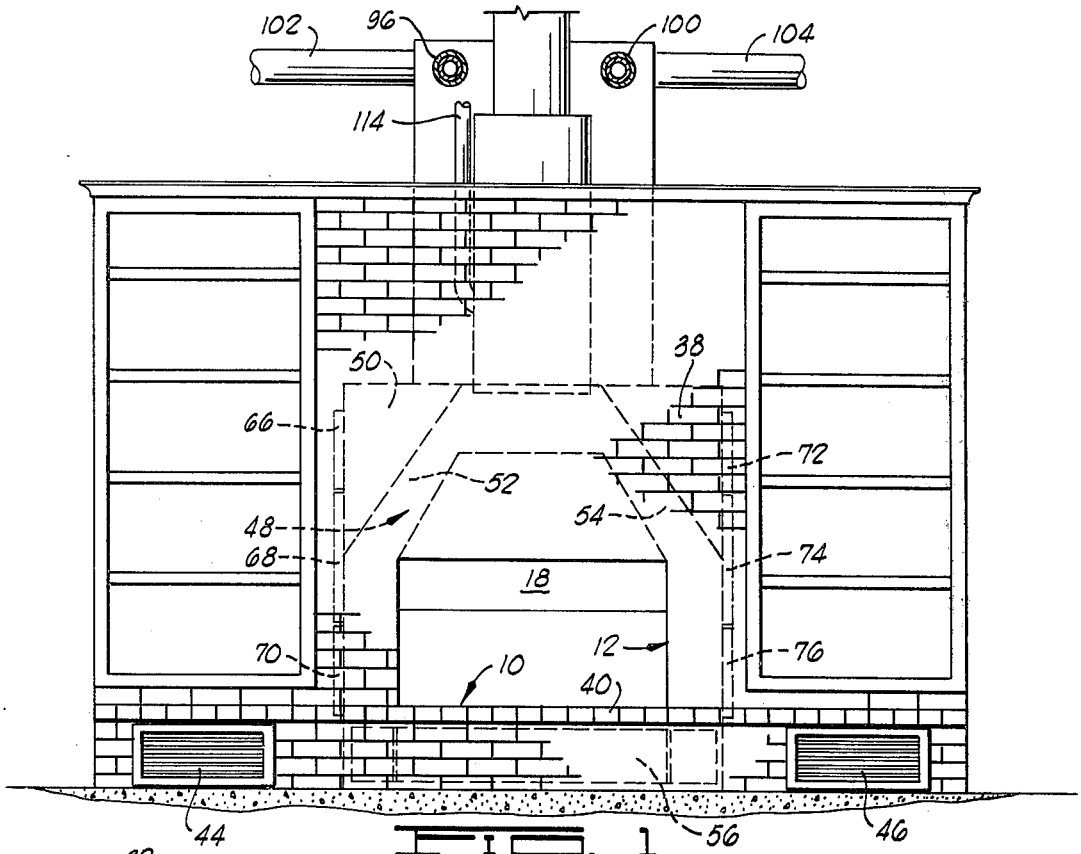
FIG. 1 is a front elevation view of a modular fireplace assembly constructed in accordance with the present invention.
Figure 2:
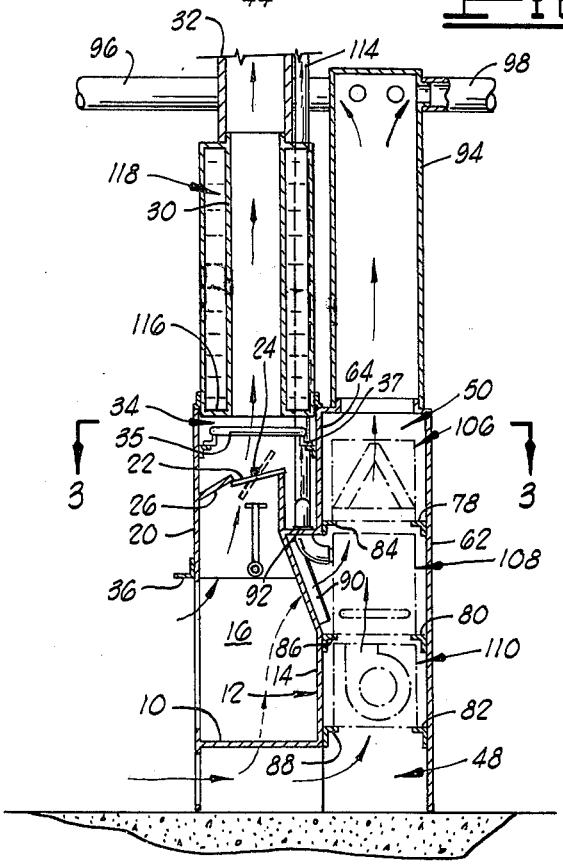
FIG. 2 is a sectional view taken along line 2—2 of FIG. 1.

Referring initially to FIG. 1 of the drawings, shown therein is the front or inwardly facing side of a modular fireplace assembly constructed in accordance with the present invention. The modular fireplace assembly includes an open hearth 10 which is surrounded at the sides and overhead by a firebox 12. The firebox 12 can be constructed of suitable metallic plates, as illustrated in FIG. 2, with such plates including a back plate 14, opposite side wall plates 16, a sloping deflector plate 18 located at the upper edge of the back plate 14, and an overhead forward plate 20.

At the upper side of the firebox 12, a damper plate 22 is pivotally mounted on a suitable operator shaft 24 in conventional fashion and cooperates with a deflector plate 26 for directing and controlling the flow of hot stack gases from the upper portion of the firebox 14 into a cylindrical stack or flue pipe 30. At its upper end, the stack or flue pipe 30 communicates with a vent pipe 32 which extends upwardly from the stack through the roof of a house (not shown) in conventional fashion. The stack 30 is spaced upwardly from the upper side of the firebox 12, and there is defined between the stack 30 and the firebox a space or enclosure 34, the purpose and construction of which will be subsequently described. Positioned within the space 34 and directly beneath a water tank, which will be hereinafter described, is a gas burner ring 35. The gas burner ring 35 is supported on a pair of angle iron elements 37 so that the gas burner ring extends horizontally, with the openings or perforations facing upwardly.

Secured to the inwardly facing side or front of the firebox 12 at the lower edge of the plate 20 is a fixed supporting angle member 36 which supports brick 38 laid up in conventional fashion as illustrated in FIG. 1 of the drawings. The finishing or veneering of the inwardly facing or forward side of the modular fireplace subassembly can be of any conventional construction, and can include extensive bricking, as shown in FIG. 1, or can include a mantle (not shown) secured above the opening of the firebox and a forwardly projecting brick ledge or platform extending inwardly from the firebox in the manner shown.

At substantially floor level (as the modular firebox assembly is placed in the home) and disposed at opposite sides of the firebox well away from the direction of inwardly radiated heat therefrom are a pair of air return ducts which are covered by suitable grille plates 44 and 46. The air return ducts communicate with an air plenum chamber designated generally by reference numeral 48.

The air plenum chamber 48 includes a rear compartment designated generally by reference numeral 50 and having a generally right parallelepiped configuration. The rear compartment 50 is provided for the purpose of channeling return air through a plurality of environmental comfort conditioning subassemblies in a manner hereinafter described. The rear compartment of the air plenum chamber 48 communicates at its opposite sides with a pair of lateral or side compartments 52 and 54, and at its lower side with a sub-hearth compartment 56 which in turn is connected to the air return ducts leading from the grilles 44 and 46 to the sub-hearth compartment. The compartment 56 is also in communication with the side or lateral compartments 52 and 54 of the air plenum chamber 48.

The rear compartment 50 of the air plenum chamber 48 is defined by a rear wall 62, an inner or front wall 64 and by the rear or outer wall 14 of the firebox 12. At its opposite sides, the rear compartment 50 includes a plurality of closure panels, with the closure panels at one side of the rear compartment being denominated by reference numerals 66, 68 and 70 (see FIGS. 1 and 3), and the closure panels at the opposite side of the rear compartment being denominated by reference numerals 72, 74 and 76. In a preferred embodiment of the invention, the central closure panels 68 and 74 at opposite sides of the rear compartment 50 of the air plenum chamber 48 are removable by disconnection from the rear wall 62 and from the side walls 64 and 14 to enable access to be had to the interior of the rear compartment 50. Preferably, the opposite sides of the rear compartment 50, as defined by the several closure panels described, face toward the inside of a closet in the home where the modular fireplace assembly is installed, and thus provide access to the interior of the rear compartment 50 of the air plenum chamber 48 via such closets for a purpose hereinafter described.

Secured to the inner side of the rear wall 62 of the rear compartment 50 at vertically spaced intervals thereon are a plurality of angle supporting members 78–82. In similar fashion, and paired in horizontal alignment with the three angle supporting members 78–82, three identical angle supporting members 84–88 are secured, respectively, to the lower edge of the inner wall 64 of the rear compartment 50 and to the back side of the rear wall 14 of the firebox 12. The angle supporting members 78, 80, 84 and 86 are bolted to the respective walls upon which they are mounted by bolts accessible from the interior of the rear compartment 50 so that these angle supporting members can be easily removed and detached from the walls upon which they are mounted.

Figure 4:
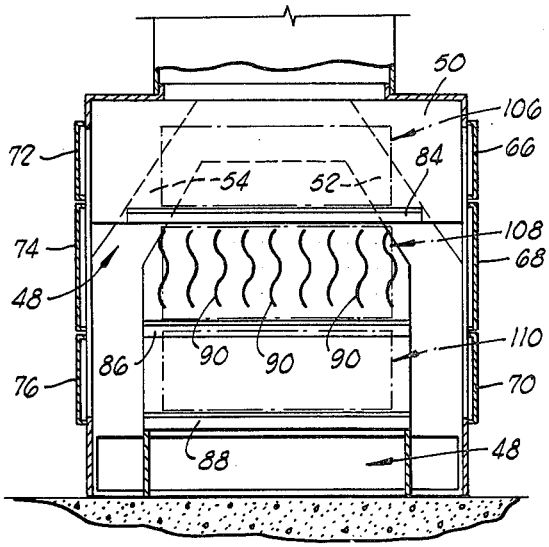
FIG. 4 is a view partially in section and partially in elevation of the modular fireplace assembly of the invention as it appears when viewed from a location immediately to the rear of the firebox and within the air plenum chamber.
Figure 5:
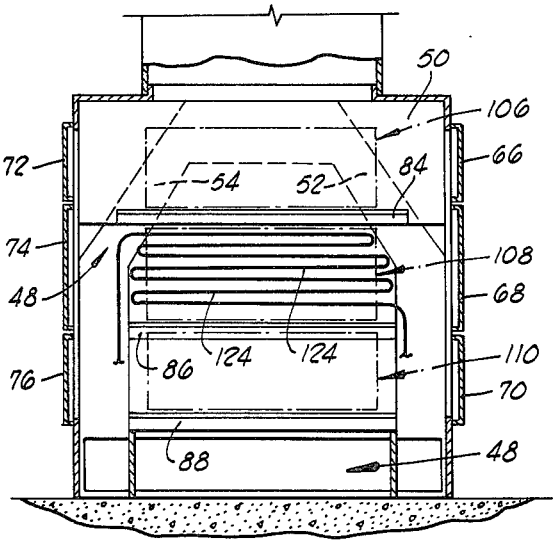
FIG. 5 is a view similar to FIG. 4 but illustrating a modified embodiment of the invention.

Welded or otherwise suitably secured to the rear side of the firebox reflector plate 18 are a plurality of serpentine heat conducting radiator bars 90 (see FIGS. 2 and 4). A closure plate 92 interconnects the upper edge of the deflector plate 18 with the lower edge of the inner wall 64 at the forward side of the rear compartment 50 of the air plenum chamber 48.

The top of the rear compartment 50 of the air plenum chamber 48 opens into and communicates with an air duct manifold 94 which extends upwardly through the ceiling of the house (not shown) and functions to distribute air from the air plenum chamber into a plurality of air conveyance ducts 96–104, which ducts lead to the various rooms of the home for distributing air thereto.

Figure 3:
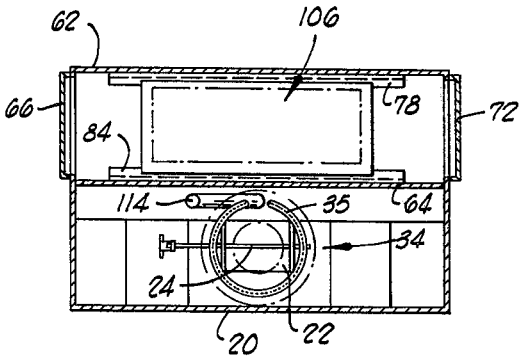
FIG. 3 is a sectional view taken along line 3—3 of FIG. 2.

Removably positioned within the rear compartment 50 of the air plenum chamber 48 are a plurality of environmental comfort conditioning subassemblies 106, 108 and 110. In the illustrated embodiment of the invention, the subassembly 106 constitutes an "A" coil type of air conditioning coil which conveys refrigerant from a compressor into a position of heat exchange with air passed over the coil. The "A" coil unit 106 is slidably supported upon the angle supporting members 78 and 84 as illustrated in FIGS. 2 and 3. The environmental comfort conditioning subassembly 108 is, in the illustrated embodiment of the invention, a gas-fired furnace unit which is mounted directly below the "A" coil unit 106, and is slidably supported upon the angle supporting members 80 and 86. The environmental comfort conditioning subassembly 110 of the illustrated embodiment of the invention is a fan or blower unit which is mounted directly below the furnace unit 108 in the rear compartment 50 of the air plenum chamber 48 and is slidably supported upon the angle supporting members 82 and 88.

A vent pipe 114 for venting combustion gases from the furnace 108 projects through the plate 92 and upwardly to a location where it passes through the roof of the home alongside the flue pipe 32 as best illustrated in FIGS. 1–3.

The cylindrical flue pipe 30 carries at its lower end an annular plate 116 which functions as a partial closure of the space 34 and also as the bottom of an annular water tank designated generally by reference numeral 118. The annular water tank 118, in the illustrated form of the invention, concentrically surrounds the duct or flue pipe 30 and extends upwardly around the duct or flue pipe over a substantial portion of its length. Suitable plumbing connections and a plumbing network (not shown) are connected to the annular water tank 118 and function to convey hot water to various hot water faucets and outlets in the home.

It should be pointed out that, as alternate constructions or modified embodiments of the present invention, the hot combustion gas pipe 114 used for venting the combustion gases from the furnace 108 can be used to discharge into the stream of combustion gases originating in the fireplace and passing upwardly through the damper plate 22 and into the stack or flue pipe 30 by terminating the pipe 114 in the space 34. In this regard, it will be noted that the space 34 is isolated from the air plenum chamber 48 so that none of the combustion gases from the fireplace can mingle with the air within, and being circulated from, the air plenum chamber. It should also be pointed out that instead of providing a circular cross-sectional hot water tank 118 of annular configuration, as shown in FIGS. 1 and 2 of the drawings, the tank 118 can be elliptically shaped to provide a relatively thin transverse dimension at the forward and rear sides thereof, so that a minimum clearance exists between the flue pipe duct 30 and the brick at the forward side of the modular fireplace assembly.

USE AND OPERATION OF THE INVENTION

The modular fireplace assembly of the invention is constructed as a unit for installation in a home while it is undergoing construction. The laying up of the brick veneer, and the emplacement at the forward side of the assembly of bookcases 124 and 126 of the sort shown in FIG. 1, can be accomplished after the composite assembly constituted by the structural elements hereinbefore described has been set in place. As previously indicated, it is preferred that at least one of the opposite sides of the rear compartment 50 of the air plenum chamber 48 at which the closure panels 66–76 are located open into a closet provided in the house where the assembly is to be installed. In this way, access can be had through either of the removable closure panels 68 and 74 to the central portion of the rear compartment 50 of the air plenum chamber 48 for a purpose hereinafter described.

During the installation of the modular fireplace assembly, appropriate plumbing connections are made to the hot water tank 118, and between "A" coil subassembly 106 and the compressor of an air conditioning system, which compressor will, in most instances, be located outside the home. Appropriate electrical connections are also made to the furnace subassembly 108, and to the blower subassembly 110. A suitable supply of gas or other fuel is connected to the furnace subassembly 108 and to the burner ring 35. It will further be understood from the following description that, though such structure is not illustrated, a thermostatic system useful for thermostatically controlling operation of the environmental comfort conditioning subassemblies 106–110, and responsive to preselected temperature levels in the house, will generally be provided.

After installation of the modular fireplace assembly of the invention, it is used in several ways, depending upon the time of the year when it is used. In wintertime, the home owner can enjoy the warmth and aesthetic value of an open fireplace in which a wood fire is built on the hearth 10 in the usual fashion and radiates heat outwardly into the room where the modular fireplace assembly is located. Also in conventional fashion, the draft through the fireplace and upwardly through the stack pipe 30 and vent pipe 32 is controlled by the setting of the damper plate 22 through the operator lever 23. As wood burns in the fireplace upon the hearth 10, the walls 14, 16 and 18 of the firebox become very hot, and heat is conducted through these walls of the firebox to air in the surrounding air plenum chamber 48. Conveyance of the heat of the fire is particularly effective from the sloping deflector plate 18 by reason of the serpentine radiator bars 90 secured to the back or rear side of this plate, and projecting into the rear compartment 50 of the air plenum chamber 48.

The circulation of air from the room in which the modular fireplace assembly is located through the air plenum chamber 48 and into the duct manifold 94 occurs as a result of the drawing action of the blower subassembly 110, which is operative at this time and functions to draw air through the grates 44 and 46 and into the subcompartment 56, the side compartments 52 and 54 and the rear compartment 50 of the air plenum chamber 48. The blower unit 110 also forces a major portion of the air in the air plenum chamber upwardly through the furnace subassembly 108 and the "A" coil subassembly 106 and into the duct manifold 94.

As the modular fireplace assembly operates in this manner, a sufficient amount of heat may be transferred by conduction and radiation through the walls of the firebox 12 to air in the air plenum chamber that it is unnecessary to operate the furnace subassembly 108 in order to adequately heat the house. The need for such operation will, of course, be determined by the thermostating system which will function to constantly monitor the temperature of the air in rooms located remotely with respect to the room in which the modular fireplace assembly is located. As air from the air plenum chamber heated by heat radiated from the walls of the firebox 12 moves to the top of the duct manifold 94, it is distributed into the several air ducts 96–104 which extend to the various rooms of the house in conventional fashion.

The gases of combustion in the fireplace pass by the damper plate 22, through the chamber 34 and into the flue pipe 30. As these hot gases pass through the flue pipe 30, heat is transferred through the flue pipe 30 to water contained within the hot water tank 118. The hot water tank 118 can be plumbed to operate in complementary fashion to the regular hot water tank of the household, frequently, during the winter when the fireplace is used often, supplying most of the hot water requirement for the household. In the preferred embodiment of the invention in which the burner ring 35 is located in the space or enclosure 34, and immediately beneath the tank 118, this tank can, by appropriate sizing, be made the sole source of hot water for the household. The effect of the heat exchange which occurs between the hot combustion gases in the flue pipe 30 and the water contained within the hot water tank 118 is to cool the combustion gases sufficiently that a major portion of the time the flue pipe 32 is only perceptibly warm to the touch, and thus does not constitute a fire hazard at the location where it passes through the roof of the house.

It should be here pointed out that as an alternate or a modified construction which can be employed, an undulating water conduit or pipe 124 can be provided on the rear side of the deflector plate 18 in lieu of, or even in conjunction with, the serpentine heat radiating bars 90, and can be used to provide a source of hot water for use in the household. In this arrangement, water carried in the serpentine pipe 124 is conveyed by suitable piping to the regular hot water tank for the household, and will function to heat water for storage in that tank, and ultimate usage, at times when the fireplace is in use in the wintertime. The convoluted water conduit 124 can either be used in conjunction with the hot water tank 118, or in lieu thereof in various forms of construction of the invention.

During the daytime in winter, or on other occasions when it is not desired to build a fire on the hearth 10 in the modular fireplace assembly, heating for the household is provided by use of the furnace unit subassembly 108. When the furnace unit subassembly 108 is in operation, the blower subassembly 110 functions to circulate air from the plenum chamber 48 through the furnace subassembly and upwardly into the duct manifold 94. The air is then distributed through the ducts 96–104 to the several rooms in the home. The hot gases of combustion from the furnace unit 108 are vented through the vent pipe 114. Where the vent pipe, in an alternate construction, is caused to vent into the enclosure 34, suitable automatic controls are preferably provided to assure that the damper plate 22 will be closed to prevent any leakage of combustion gases back through the open damper plate and into the room via the firebox 12. With this type of construction, the hot combustion gases from the furnace unit 108 pass upwardly through the flue pipe 30 and will yield a significant quantity of heat to the water contained in the water tank 118.

It should also be pointed out that during the daytime in winter, or during the more moderate months of the year, heat for the purpose of heating the water in the water tank 118 can be supplied by energizing the burner ring 35 which is positioned directly beneath the tank 118. When the burner ring 35 is in use, the hot combustion gases therefrom are vented through the flue pipe 30 in the manner previously described.

In the summer months when the weather is sufficiently hot to require air conditioning of the home, the air conditioning system is energized so that refrigerant is passed from the compressor through the "A" coil subassembly 106. The furnace unit is, of course, off and the blower subassembly 110 is, at this time, also energized. Air is thus caused to circulate through the air plenum chamber 48 across the "A" coil subassembly 106 and up into the manifold duct 94. From the manifold duct 94, the cooled air is distributed to the rooms through the air ducts 96–104.

On those occasions when it is necessary to maintain or repair one or more of the units in the environmental comfort conditioning subassemblies 106–110, these subassemblies are easily accessible by removal of either of the removable closure panels 68 or 74 to provide access to the interior of the rear compartment 50 of the air plenum chamber 48. It will be noted in referring to FIG. 1 that the removable closure panels 68 and 74 are larger in vertical direction than either the closure panels 66 and 70 or 72 and 76. This dimension of the removable closure panels permits access to be had, not merely to the furnace subassembly 108 disposed in the center of the rear compartment 50, but also to the bolts by which the angle supporting members 78, 80, 84 and 86 are secured to their respective supporting walls. Thus, after one of the removable closure panels 68 or 74 has been removed or disconected from the walls defining the rear compartment 50 of the air plenum chamber 48, the furnace unit subassembly 108 may be disconnected from its gas and electrical connections and slid out of the rear compartment 50 for servicing, repair or replacement. It is also possible, at this time, by removing the small number of bolts which secure the respective angle supporting members 78, 84, 80 and 86, to easily remove either the "A" coil unit 106 or the blower unit from the rear compartment, or both of these units can be removed.

It will be noted particularly in referring to FIG. 2 of the drawings that it is possible to interchange the locations of the blower unit subassembly 110 and the "A" coil unit subassembly 106. The value of this flexibility is that the circulation of conditioned air through the air plenum chamber 48, and through the duct manifold 97 and air ducts 96–104 to the several rooms of the house can be reversed in direction, and a down draft type of circulation provided, as contrasted with the updraft circulation illustrated and hereinbefore described. The interchange of the locations of these units will, of course, facilitate reversal of the direction of air flow, whether the modular fireplace assembly is being used, or air conditioning and the circulation of cool air is being effected.

Figure 6:
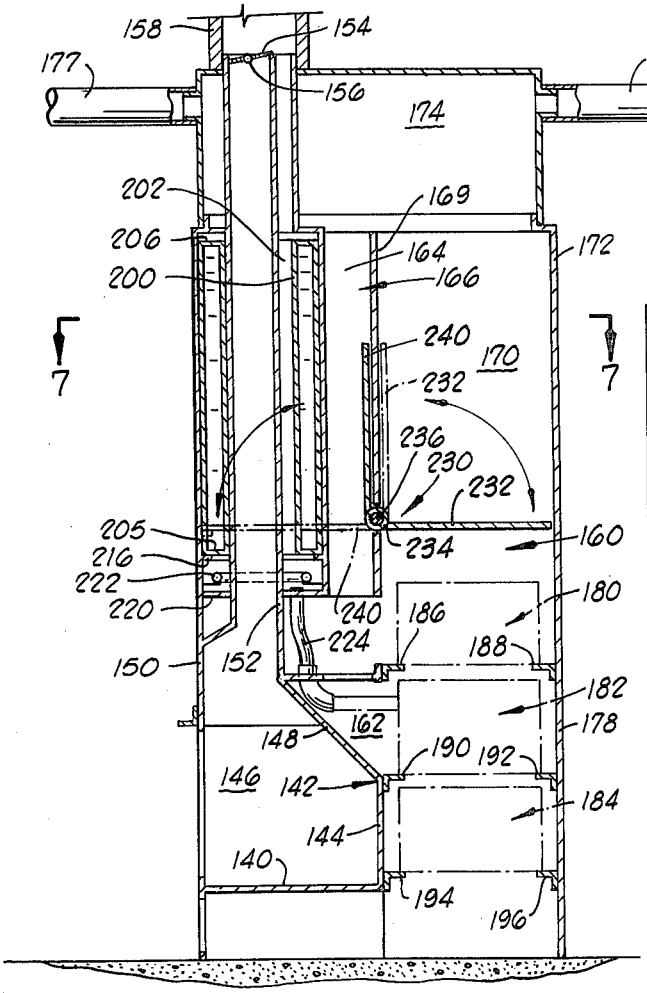
FIG. 6 is a sectional view similar to FIG. 2, but illustrating a modified embodiment of the invention.
Figure 7:
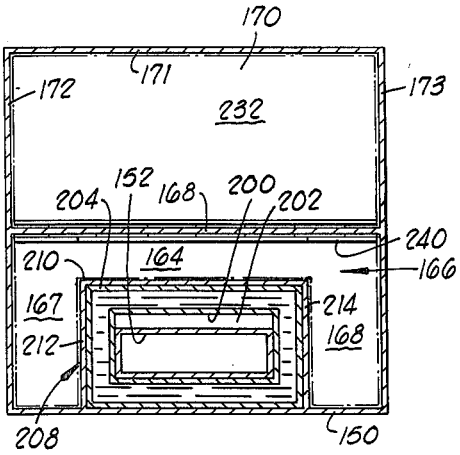
FIG. 7 is a sectional view taken along line 7—7 of FIG. 6.

FIGS. 6 and 7 show a modified embodiment of the invention. Referring to FIG. 6, the modular fireplace assembly, in the embodiment there illustrated, includes an open hearth 140 which is surrounded at the sides and overhead by a firebox 142. The firebox 142 is constructed similarly to that already described, and illustrated in FIGS. 1 and 2, and includes a back plate 144, opposite side wall plates 146, a sloping deflector plate 148 located at the upper edge of the back plate 144, and an overhead forward plate 150. At its upper side, the firebox 142 opens into a stack or flue pipe 152 of substantially rectangular cross-sectional configuration. The upper end of the stack or flue pipe 152 has mounted therein a damper plate 154 which is pivotally supported on a suitable operator shaft 156. The stack or flue pipe 152 opens at its upper end into a vent pipe 158 which passes out through the roof of the structure in which the modular fireplace assembly is located in conventional fashion.

The modular fireplace assembly embodiment illustrated in FIGS. 6 and 7 also includes a lower air plenum chamber, designated generally by reference numeral 160, and of the general type hereinbefore described. The air plenum chamber 160 thus includes a rear compartment 162 behind the firebox 142, and a pair of lateral or side compartments (not shown) similar to the side compartments 52 and 54 located on opposite sides of the firebox 12 in the embodiment of the invention illustrated in FIGS. 1 and 2. The rear compartment 162 and the two lateral or side compartments of the firebox communicate with an upper air plenum chamber, designated generally by reference numeral 166. The U-shaped cross-sectional configuration of the upper air plenum chamber 166 is best portrayed in FIG. 7 of the drawings and will be seen to include, in addition to a rear portion 164 of the plenum chamber, a pair of lateral or side chambers 167 and 168 which are directly above the lateral or side chambers of the lower air plenum chamber 160 which are disposed on opposite sides of the firebox 142.

The upper air plenum chamber 166 is partitioned by a vertically extending wall 169 from a vertically extending air conditioning duct 170 which is defined between the walls 169 and 171 and side walls 172 and 173, and communicates at its lower end with the upper end of the rear compartment 162 of the lower air plenum chamber 160. As illustrated in FIG. 6, the upper end of both the air plenum chamber 166 and the air conditioning duct 170 communicate with air distribution manifold 174 which functions to collect heated or cooled air from the modular fireplace assembly below and distribute this air through a plurality of ducts, including the illustrated ducts 176 and 177, to the several rooms of the house or other structure in which the modular fireplace assembly is located.

The rear compartment 162 of the lower air plenum chamber 160 is closed by a vertically extending rear wall 178 and by removable closure panels (not shown) disposed at the opposite sides of the rear compartment 162 in the manner previously described to facilitate access to environmental comfort conditioning subassemblies of the type hereinbefore described. The environmental comfort conditioning subassemblies, depicted in dashed lines in FIG. 6 and located in the rear compartment 162 of the lower plenum chamber 160, include an air conditioning coil 180, a gas-fired furnace unit 182 and a fan or blower 184. These environmental comfort conditioning subassemblies are slidably supported on angle supporting members in the manner hereinbefore described. The angle supporting members which support the air conditioning coil unit 180 are designated by reference numerals 186 and 188; those which support the furnace unit 182 are designated by reference numerals 190 and 192, and the angle supporting members which support the blower 184 are designated by reference numerals 194 and 196.

It will be noted in referring to FIGS. 6 and 7 that the stack or flue pipe 152 which projects upwardly from the firebox 142 is located within a surrounding generally rectangularly cross-sectioned duct 200, which duct is larger in its transverse dimension than the flue pipe 152 so as to define therewith a burner stack passageway 202 located at the rear of the flue pipe. The rectangular cross-sectioned wall of the duct 200 cooperates with the outer tank wall 204, also of rectangular cross-sectional configuration, and with bottom and top closure walls, 205 and 206, respectively, to define a rectangular hot water tank in which is located hot water to be heated and circulated into the household in the manner heretofore generally described. The hot water tank is set into a receiving housing, designated generally by reference numeral 208, and made up by the wall 150, a parallel back wall or plate 210 and a pair of side walls 212 and 214 as illustrated in FIG. 7. The tank is supported upon a pair of flanges 216 carried on the inner sides of the walls 150 and 210.

Positioned below the hot water tank in a space defined below the bottom wall 205 thereof and above a transverse wall 220 which closes the bottom of the housing 208 around the stack 152 is an auxiliary burner 222 which can be utilized, in a manner hereinafter described, for heating hot water in the hot water tank at certain times when neither the fireplace nor the furnace unit 182 is in use. The combustion products from the auxiliary burner 222 are vented through the burner stack passageway 202. In like manner, the gaseous products of combustion from the furnace unit 182 are vented through a vent pipe 224 which projects up through the transverse wall 220, and is thus placed in communication with the burner stack passageway 202 to facilitate discharge into the vent pipe 158 of the noxious products of combustion resulting from the operation of the furnace unit.

For the purpose of facilitating the flow of air from the lower plenum chamber 160 into either the vertically extending air conditioning duct 170 or the upper air plenum chamber 166 at different times of usage of the modular fireplace assembly of the invention, a valve member designated generally by reference numeral 230 is provided. The valve member includes a substantially rectangular flap element 232 which, in the illustrated position, extends horizontally across the vertically extending air conditioning duct 170, and has one side edge thereof joined to a sleeve 234 which surrounds and is keyed to a pivot pin 236. The pivot pin 236 extends horizontally through the vertical wall 168 at a location near the lower end thereof, and functions to pivotally support the valve assembly 230 for pivotation through 90° (from the position shown in full lines in FIG. 6 to the position shown in dashed lines therein). The last element of the valve assembly 230 is a substantially U-shaped flap element 240 which, in the position illustrated in full lines in FIG. 6, extends substantially vertically, and lies immediately adjacent that side of the vertically extending wall 169 which is at the back side of the upper air plenum chamber 166. The U-shaped flap element 240 includes a web portion and a pair of legs extending therefrom, which web portion and legs are configured to match the dimensions of the rear portions 164 and side chambers 167 and 168 of the upper air plenum chamber 166. Thus, when the valve assembly 230 is pivoted from its position illustrated in full lines to the position illustrated in dashed lines in FIG. 6, the U-shaped flap element 240 will close or block the upper air plenum chamber. It will also be perceived that when the valve assembly 230 is pivoted in the manner described, the rectangular flap element 232 is pivoted upwardly to its vertically extending position to open up the vertically extending air conditioning duct 170, and place this duct in communication with the rear compartment 162 of the lower air plenum chamber 160.

In the operation and use of the embodiment of the modular fireplace assembly of the invention as it is depicted in FIGS. 6 and 7, the status of the various parts of the assembly is again dictated, in large part, by the season of the year during which the assembly is being used. In winter, a fire will frequently be built upon the open hearth 140 within the firebox 142. The fire will heat the air drawn into the lower air plenum chamber 160 and the combustion products from burning of wood in the fireplace will be vented through the flue pipe 152. At this time during operation of the assembly, the valve member 230 will be positioned in the orientation illustrated by the full line depiction of the elements of the valve member in FIG. 6. In this status, the rectangular flap element 232 extends horizontally across the vertically extending air conditioning duct 170 to prevent passage of air from the lower plenum chamber 160 into the air conditioning duct. The flap element 240 will extend upwardly along the inner side of the wall 169 so as to open the upper plenum chamber 166 to passage of the heated air from the lower plenum chamber 160 upwardly.

It will be perceived that the hot stack gases from the fire in the firebox 142, in passing upwardly through the flue pipe or stack 152, transmit heat through the walls of the flue pipe to the water in the water tank which surrounds the flue pipe on three sides as illustrated in FIG. 7. It will also be noted in referring to FIG. 7 that the hot air moving upwardly in the upper air plenum chamber 166 also surrounds the water tank on three sides and that the heat from this air is transmitted through the walls of the water tank and the side walls 212 and 214 to the water within the tank. Hot water for use in the household is thus produced during the burning of wood in the fireplace.

At times when the fireplace is not in use, the gas-fired furnace unit 182 may be employed to provide heat for the household. At this time, this unit heats the air in the lower plenum chamber 160 and such air rises upwardly though the upper plenum chamber 166 to the air distribution manifold 174. The warm air is then distributed from this manifold through the ducts 176 and 177 to the rooms of the household in which the assembly is located. The hot air thus moving upwardly through the upper air plenum chamber 166 also functions to effectively transmit a portion of its heat to the water located in the water tank. Depending upon the demands of the structure in which the assembly is located for warm air in order to maintain the necessary warmth in the structure at this time, it may be necessary or desirable to also utilize the auxiliary burner 222 for heating the water in the tank. When either the furnace unit 182 or the auxiliary burner 222 is utilized, the hot combustion gases from these structures are vented through the burner stack passageway 202 and ultimately to the atmosphere via the vent pipe 158. The hot combustion gases, in traversing the burner stack passageway 202, also yield up a substantial portion of the heat of such gases to the water in the surrounding water tank (see FIG. 7).

During the hot months of the year when air conditioning is desirable, the valve member 230 is actuated to pivot the flap elements 232 and 240 through 90°. This effectively opens the vertically extending air conditioning duct 170 and places it in communication with the rear compartment of the lower air plenum chamber 160 and concurrently closes the upper plenum chamber by pivoting the flap element 240 downwardly to a location where it extends horizontally and closes the rear portion 164 and lateral or side chambers 167 and 168 of the upper plenum chamber 166. The air conditioning coil 180 is then placed in service in conventional fashion, and the fan or blower unit 184 is actuated. This circulates air entering the lower plenum chamber 160 through the previously described returns upwardly through the air conditioning coil 180, and such upwardly moving air continues on up into the air conditioning duct 170. Ultimately the air is distributed to the rooms of the structure in which the assembly is located by passage through the air distribution manifold 174 and the ducts 176 and 177.

It will be noted that at the time when the assembly is in its air conditioning status as described, the auxiliary burner 222 can still be utilizied for heating the water in the water tank which is located above this burner. At this time, as previously described, the hot combustion gases from the auxiliary burner pass upwardly through the burner stack passageway 202 and, in doing so, impart a portion of the sensible heat of these combustion gases to the water in the water tank.

From the foregoing description of the invention, it will be perceived that the present invention provides a highly useful, compact and relatively easily installed modular fireplace assembly which will enable recovery of a very high percentage of the total heat content of the heat developed upon the burning of wood in an otherwise conventional fireplace. Further, the assembly, as constructed, by its compactness and the location of critical operating units, enables space to be saved in the house in which the assembly is located, and easy access to be had to the several environmental comfort conditioning subassemblies when repair or maintenance is required. In the preferred embodiments of the invention, the modular fireplace assembly facilitates the efficient heating of water contained in the hot water tank 118 or circulated through the serpentine hot water coil 124.

Although several preferred embodiments of the invention have been herein described in order to provide an example of the manner in which the basic principles underlying the invention are to be utilized, it will be understood that various changes and innovations in the described structure and the mode of its usage can be effected without departure from such basic principles. Such changes and innovations as thus may be made, which continue to rely on these basic principles, are therefore deemed to be circumscribed by the spirit and scope of the invention, except as the same may be necessarily limited by the appended claims or reasonable equivalents thereof.

What is claimed is:

1. A modular fireplace assembly comprising:

a hearth;

a firebox around and over the hearth and open at one side at the forward side of the hearth;

an air plenum chamber on opposite sides of, and to the rear of, the firebox in heat transfer relation thereto;

a blower subassembly positioned in said air plenum chamber at a location to the rear of the firebox;

duct means connected to said air plenum chamber for conveying air between the plenum chamber and a plurality of rooms;

an air conditioning coil subassembly positioned between said blower subassembly and said duct means at a location within said air plenum chamber and to the rear of said firebox;

a stack connected to the upper side of the firebox and extending upwarding therefrom for receiving and venting combustion gases from the firebox;

a vertically extending water tank adjacent and surrounding said stack for receiving heat by conduction from gases passing through said stack; and a ring-shaped burner positioned over said firebox and under said water tank and positioned around the path of flow of combustion gases from said firebox upwardly in said stack and positioned to vent combustion gases from the burner into said stack.

2. A modular fireplace assembly as defined in claim 1 wherein said blower subassembly and said air conditioning coil subassembly are removable from said air plenum chamber and are interchangeable in their positions in said air plenum chamber.

3. A modular fireplace assembly having interchangeable blower and air conditioning subassemblies comprising:

a hearth;

a firebox around and over the hearth and open at one side at the forward side of the hearth;

an air plenum chamber on opposite sides of, and to the rear of, the firebox in heat transfer relation thereto;

a plurality of spaced serpentine heat radiating bars secured to the firebox and projecting into said air plenum chamber for warming air passing therethrough;

a plurality of environmental comfort conditioning subassemblies positioned in a portion of said air plenum chamber to the rear of the firebox for thermally conditioning and circulating air into and out of the air plenum chamber;

duct means connected to said air plenum chamber for conveying air between the air plenum chamber and a plurality of rooms; and a stack connected to the upper side of the firebox and extending upwardly thereform for receiving and venting combustion gases from the firebox.

4. A modular fireplace assembly comprising:

a hearth;

a firebox around and over the hearth and open at one side at the forward side of the hearth;

an air plenum chamber on opposite sides of, and to the rear of, the firebox in heat transfer relation thereto;

a plurality of environmental comfort conditioning subassemblies positioned in a portion of said air plenum chamber to the rear of the firebox for thermally conditioning and circulating air into and out of the plenum chamber;

duct means connected to said air plenum chamber for conveying air between the air plenum chamber and a plurality of rooms;

a stack connected to the upper side of the firebox and extending upwardly therefrom for receiving and venting combustion gases from the firebox;

an air conditioning duct communicating with said air plenum chamber;

a second air plenum chamber above said first-mentioned air plenum chamber and communicating therewith, a distribution manifold connected to said air conditioning duct and said second air plenum chamber for receiving air therefrom;

valve means for selectively directing air from said first-mentioned air plenum chamber into either said second air plenum chamber or said air conditioning duct; and a water tank adjacent said second air plenum chamber and adjacent said stack for receiving heat by conduction from gases passing through said stack.

5. A modular fireplace assembly as defined in claim 4 wherein said environmental comfort subassemblies include a blower subassembly; and an air conditioning coil subassembly positioned between said blower subassembly and said duct means.

6. A modular fireplace assembly as defined in claim 5 wherein said environmental comfort subassemblies further include a furnace subassembly positioned between said blower subassembly and said air conditioning coil subassembly in said plenum chamber.

7. A modular fireplace assembly as defined in claim 6 and further characterized as including a burner positioned over said firebox and under said water tank;

a burner stack passageway above said burner and adjacent said water tank; and means for conveying combustion gases from said furnace subassembly and said burner into said burner stack passageway.

8. A modular fireplace assembly as defined in claim 4 wherein a portion of said second air plenum chamber is positioned between said air conditioning duct and said water tank to thermally insulate said air conditioning duct from said water tank.

9. A modular fireplace assembly as defined in claim 4 and further characterized as including angle supporting members secured to the inner sides of said first-mentioned air plenum chamber, and removably supporting said environmental comfort conditioning subassemblies.

10. A modular fireplace assembly comprising:

a hearth;

a firebox around and over the hearth and open at one side at the forward side of the hearth;

an air plenum chamber adjacent the firebox and in heat transfer relation thereto;

a plurality of environmental comfort conditioning subassemblies positioned in a portion of said air plenum chamber for theremally conditioning and circulating air into and out of the air plenum chamber;

duct means connected to said air plenum chamber for conveying air between the plenum chamber and a plurality of rooms;

a stack connected to the upper side of the firebox and extending upwardly therefrom for receiving and venting combustion gases from the firebox;

an air conditioning duct communicating with said air plenum chamber;

a second air plenum chamber above said first-mentioned air plenum chamber and communicating therewith;

a distribution manifold connected to said air conditioning duct and said second air plenum chamber for receiving air therefrom;

valve means for selectively directing air from said first-mentioned air plenum chamber into either said second air plenum chamber or said air conditioning duct; and water heating means in said second air plenum chamber.

* * * * *